US005456029A

United States Patent [19]

Cornelius

[11] Patent Number: 5,456,029

[45] Date of Patent: Oct. 10, 1995

[54] TOOTH TO ADAPTER COUPLER

[75] Inventor: Erwin D. Cornelius, Bloomington, Ill.

[73] Assignee: Caterpillar Inc., Peoria, Ill.

[21] Appl. No.: 143,773

[22] Filed: Nov. 1, 1993

[51] Int. Cl.[6] ..... E02F 9/28

[52] U.S. Cl. ..... 37/456; 37/452; 37/455; 172/713

[58] Field of Search ..... 37/452, 453, 454, 37/455, 456; 172/702, 713, 762, 769, 772, 772.5; 403/333, 334

[56] References Cited

U.S. PATENT DOCUMENTS

| | | | |
|---|---|---|---|
| 1,205,969 | 11/1916 | Brinton | 37/456 |
| 1,330,143 | 2/1920 | Seal | 37/455 |
| 1,808,311 | 6/1931 | Madonna | 37/456 |
| 2,256,488 | 9/1941 | Murtaugh | 37/455 |
| 2,919,506 | 1/1960 | Larsen | 37/142 |
| 2,921,391 | 1/1960 | Opsahl | 37/454 |
| 3,256,622 | 6/1966 | Hostetter | 172/762 |
| 3,444,633 | 5/1969 | Hensley | 37/452 |
| 3,508,352 | 4/1970 | Radwill | 37/455 |
| 3,881,262 | 5/1975 | Cullen | 37/455 |
| 4,047,583 | 9/1977 | Dyer | 403/334 X |
| 4,182,058 | 1/1980 | Poncin | 37/458 |
| 4,231,173 | 11/1993 | Davis | 37/142 R |
| 4,326,348 | 4/1982 | Emrich | 37/453 |
| 4,428,131 | 1/1984 | Hahn | 37/142 R |
| 4,587,751 | 5/1986 | Sjogren et al. | 37/142 R |
| 4,716,667 | 1/1988 | Martin | 37/453 |
| 4,903,420 | 2/1990 | Kreitzberg et al. | 37/456 X |
| 4,913,579 | 4/1990 | Campana | 403/298 X |
| 5,144,762 | 9/1992 | Robinson | 37/453 X |
| 5,172,501 | 12/1992 | Pippins | 37/453 |
| 5,210,965 | 5/1993 | Funk, Sr. et al. | 37/452 X |
| 5,272,824 | 12/1993 | Cornelius | 37/456 X |
| 5,337,495 | 8/1994 | Pippins | 37/453 |
| 5,386,653 | 2/1995 | Cornelius | 37/454 |

FOREIGN PATENT DOCUMENTS

| | | | |
|---|---|---|---|
| 4306329 | 10/1992 | Japan | 37/456 |

*Primary Examiner*—Randolph A. Reese
*Assistant Examiner*—Andrea Chop
*Attorney, Agent, or Firm*—J. W. Burrows

[57] ABSTRACT

Couplers have been utilized to connect a tooth to an adapter of an implement. It is advantageous to have a coupler that effectively and efficiently transfers forces subjected to the tooth to the adapter of the implement. Furthermore, it is advantageous to have a coupler that can be quickly and easily mounted to the adapter and likewise is able to quickly and easily assemble and disassemble a tooth thereto. In the subject arrangement, a coupler is provided and has a tooth mounting portion with a nose portion having a pair of load bearing surfaces, a pair of spaced apart grooves, a pin opening, and a transverse opening that is oriented perpendicular with and in intersecting relationship with the pin opening. The coupler also includes an adapter receiving portion which has a cavity defined therein with a pair of spaced apart load transferring surfaces located in the cavity generally adjacent the bottom thereof and a retainer opening defined therein in intersecting relationship with the cavity. The subject arrangement effectively transfers forces from the tip to the adapter of the implement and, likewise, is quick and easy to assemble and disassemble.

10 Claims, 6 Drawing Sheets

TOOTH TO ADAPTER COUPLER

TECHNICAL FIELD

This invention relates generally to a coupler for connecting a tooth to an adapter and more specifically to the structure of the coupler.

BACKGROUND ART

Couplers have been used in many applications where the teeth and adapters that are mounted on an implement are quite large and/or experience high frequency of change due to rapid wearing of the respective elements. These known couplers must be able to have a tooth quickly assembled thereto or disassembled therefrom and likewise the coupler must be capable of being quickly assembled to or disassembled from the adapter on the implement. Furthermore, high forces imposed on the tooth, during operation, must be readily and effectively transferred through the coupler to the adapter on the implement in order to maintain maximum operating efficiency.

The present invention is directed to overcoming one or more of the problems as set forth above.

DISCLOSURE OF THE INVENTION

In one aspect of the present invention, a coupler is provided and adapted to connect a tooth to an adapter. The coupler has a tooth mounting portion having a nose portion with a pair of spaced apart generally parallel transverse load bearing surfaces, a pair of generally parallel spaced apart grooves located adjacent the nose portion and extending rearwardly therefrom, a pair of generally parallel spaced apart mounting surfaces located adjacent to and in overlapping relationship with the nose portion, a pin opening defined therethrough between the pair of generally parallel spaced apart mounting surfaces and oriented generally perpendicular to the pair of load bearing surfaces, and a transverse opening defined in the nose portion generally perpendicular with and in intersecting relationship with the pin opening. The coupler also has an adapter receiving portion having an end surface, a cavity defined therein extending inwardly from the end surface, a retaining opening defined therein in intersecting relationship with the cavity, and a pair of spaced apart generally parallel load transferring surfaces located in the cavity generally adjacent the bottom thereof.

The present invention provides a coupler that enables a tooth to be quickly mounted thereon and is effective to readily transfer forces from the tooth to an adapter mounted on an implement.

BEST MODE FOR CARRYING OUT THE INVENTION

Figure 1:
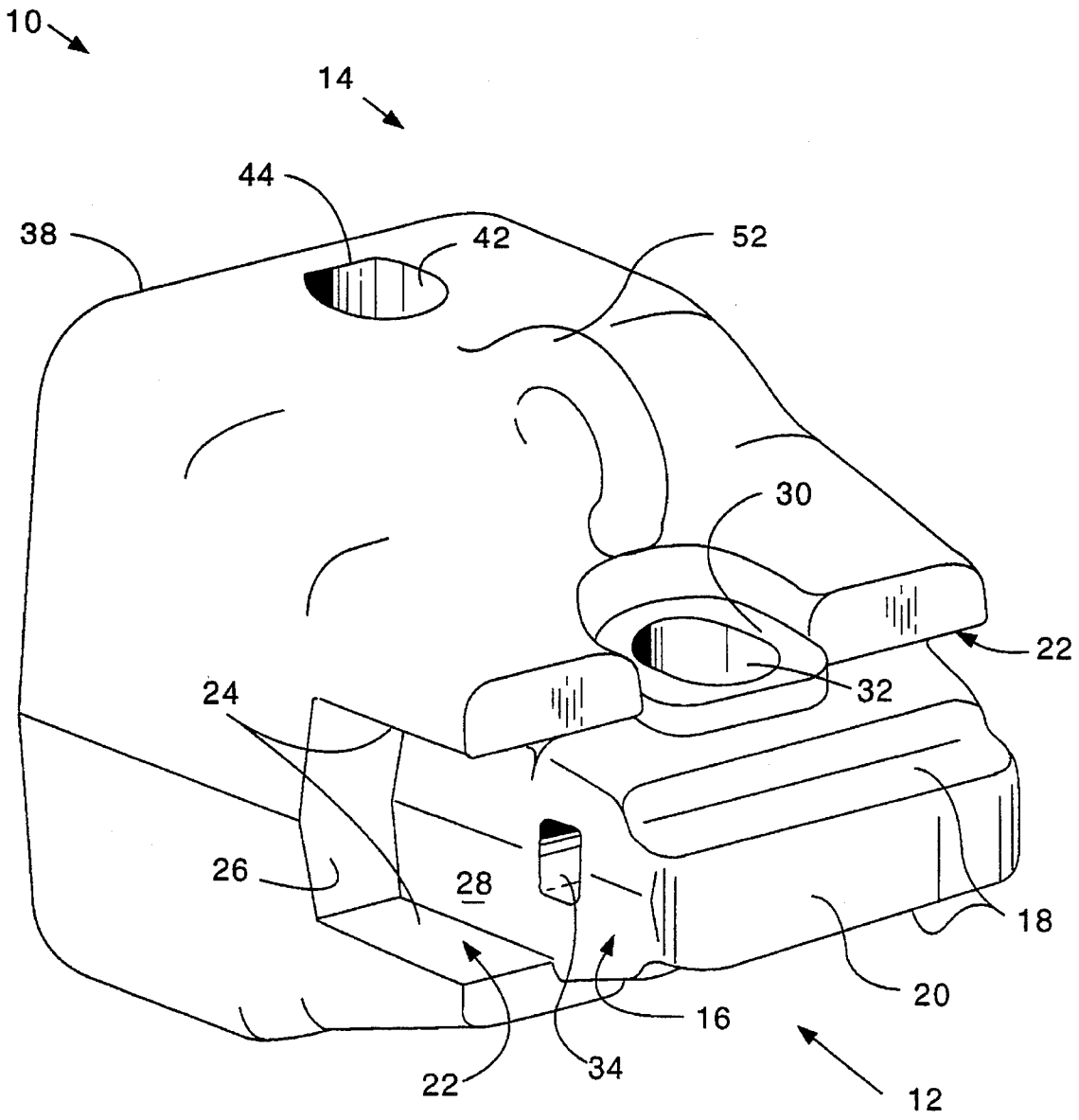
FIG. 1 is a diagrammatic representation of a coupler incorporating an embodiment of the present invention.
Figure 2:
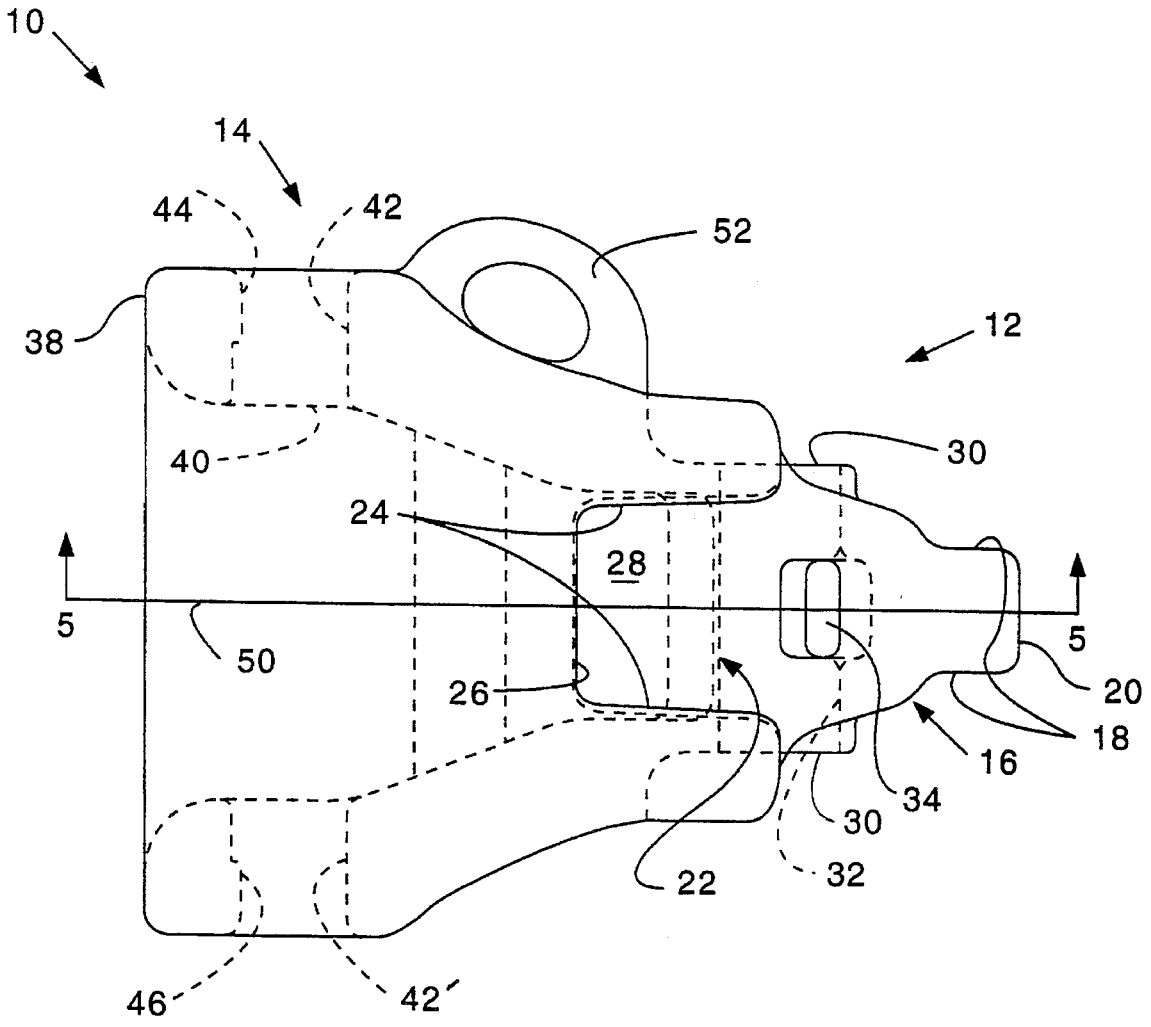
FIG. 2 is a side elevational view of the coupler of FIG. 1.

Referring to the drawings, a coupler 10 is shown and adapted for connecting a tooth (not shown) to an adapter (not shown). The coupler has a tooth mounting portion 12 and a longitudinally disposed adapter receiving portion 14. The tooth mounting portion 12 has a nose portion 16 with a pair of spaced apart generally parallel transverse load bearing surfaces 18 located adjacent an end surface 20 thereof.

A pair of generally parallel spaced apart grooves 22 are disposed on the tooth mounting portion located adjacent the nose portion 16 and extends rearwardly therefrom. Each groove of the pair of spaced apart grooves 22 is defined by a pair of side wall surfaces 24 angled one relative to the other, an end wall surface 26 and a generally flat bottom surface 28.

A pair of generally spaced apart mounting surfaces 30 are provided on the tooth mounting portion 12 and located and in overlapping relation with the nose portion 16. A pin opening 32 is defined in the tooth mounting portion 12 between the pair of spaced apart mounting surfaces 30 and oriented generally perpendicular to the pair of load bearing surfaces 18. A transverse opening 34 is defined in the nose portion 16 and oriented generally perpendicular with and in intersecting relationship with the pin opening 32.

Figure 3:
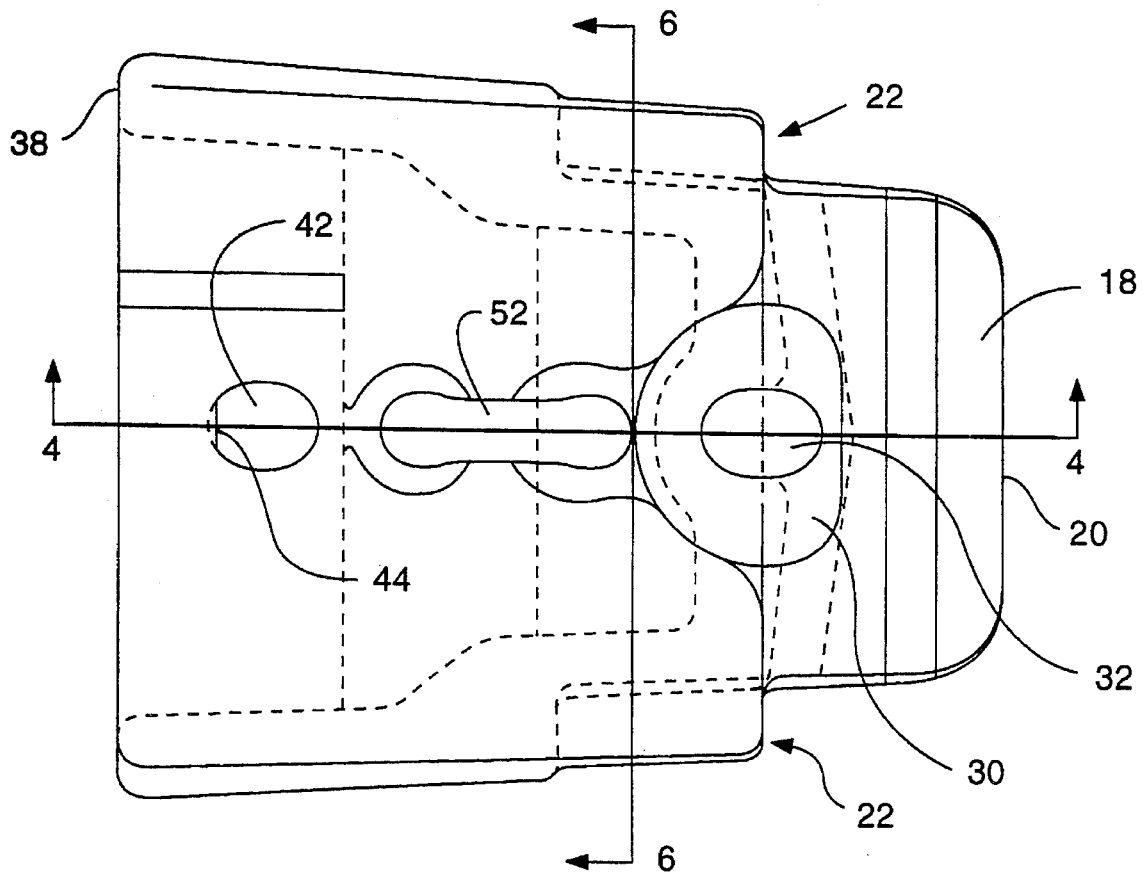
FIG. 3 is a top elevational view of the coupler of FIG. 1.
Figure 4:
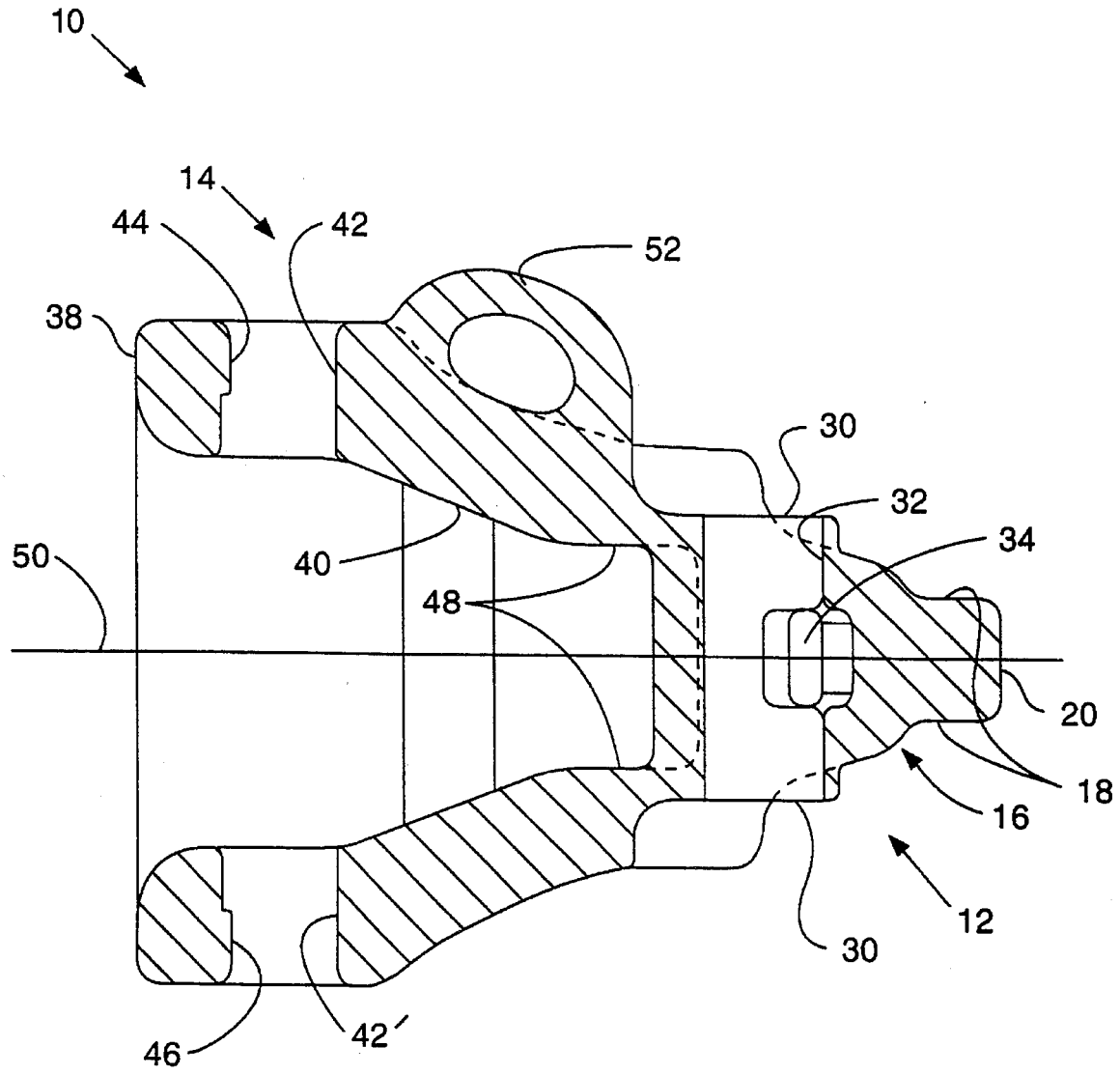
FIG. 4 is a cross sectional view taken along the line 4—4 of FIG. 3.
Figure 5:
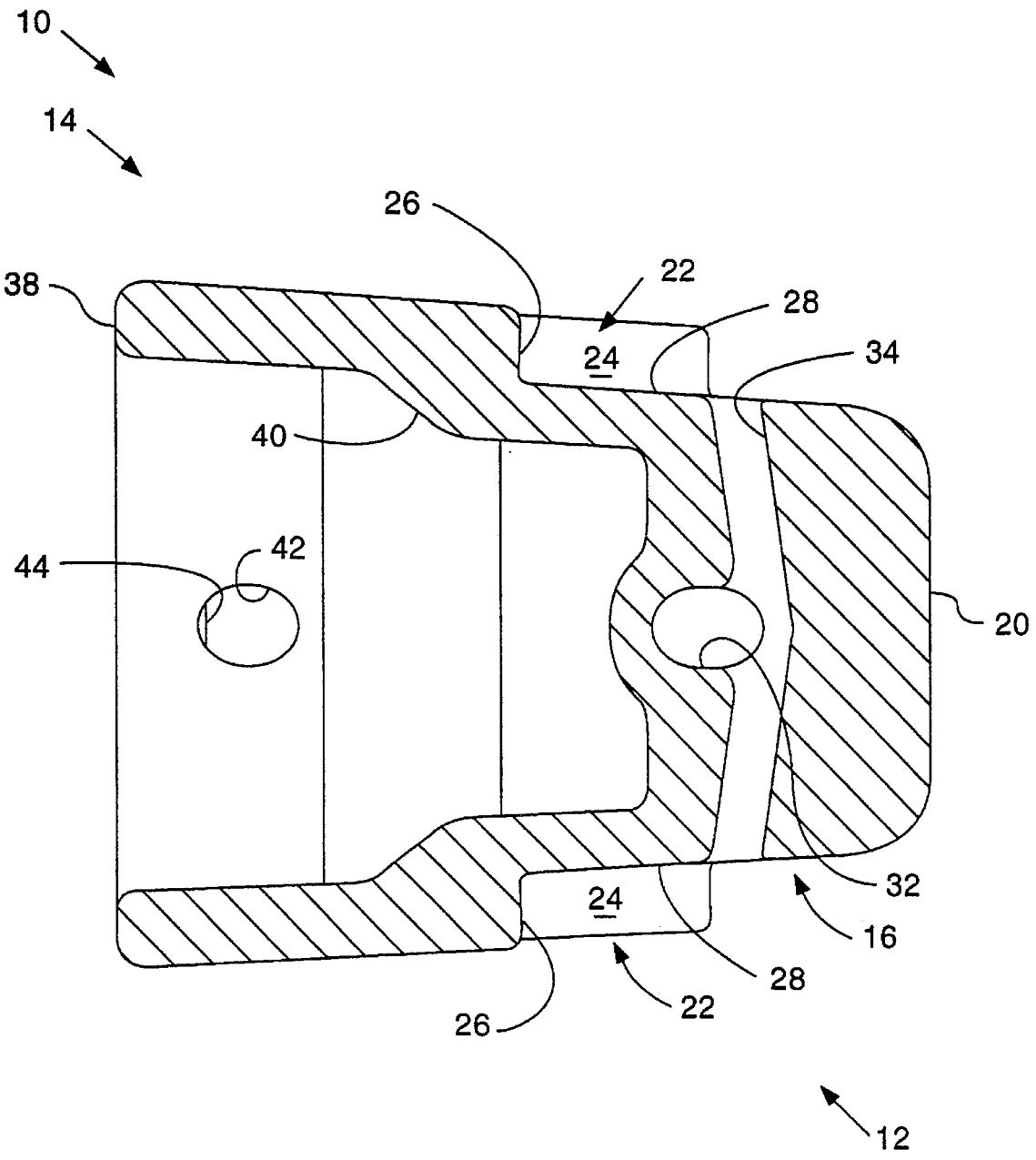
FIG. 5 is a cross sectional view taken along the line 5—5 of FIG. 2.
Figure 6:
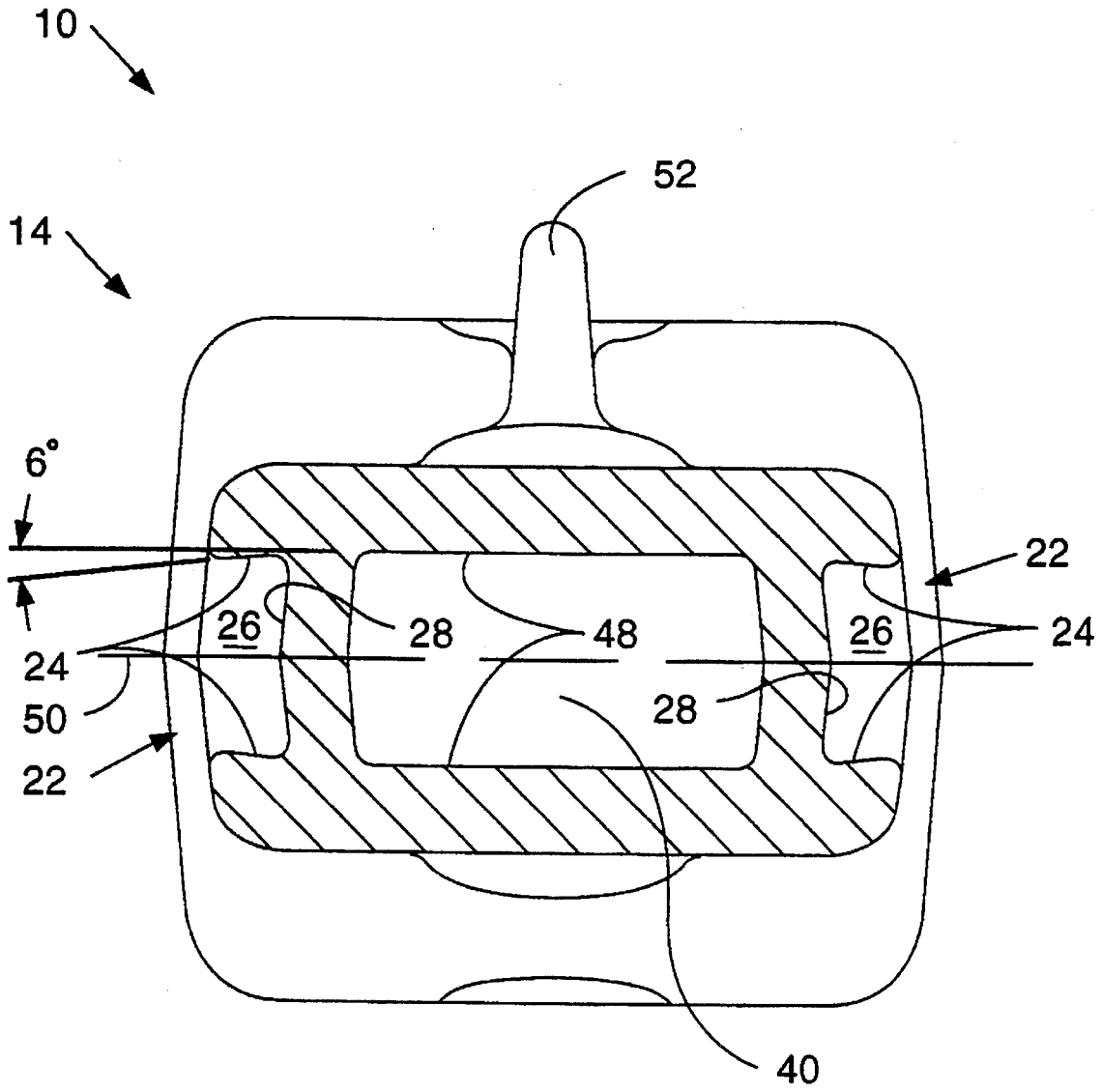
FIG. 6 is a cross sectional view taken along the line 6—6 of FIG. 3.

The adapter receiving portion 14 has an end surface 38 and a cavity 40 defined therein extending inwardly from the end surface 38. A pair of aligned retainer openings 42, 42' each have an inner end located adjacent the cavity 40 and an outer end adjacent the outer side of the adapter receiving portion 14. The openings 42, 42' extend through the adapter receiving portion 14 in intersecting relationship with the cavity 40. A first protuberance 44 is disposed in one of the retainer openings 42 and located generally adjacent one end of the one retainer opening and on the side of the opening nearest the end surface 38. In the subject embodiment, the first protuberance 44 is located immediately adjacent the one end of the one retainer opening 42. In the subject arrangement, as illustrated in FIG. 3, the first protuberance 44 is a flat surface formed by material occupying a chordal sector of the retainer opening 42. A second protuberance 46 is disposed in a portion of the other retainer opening 42' and located immediately adjacent the outer end of the other retainer opening 42' and on the side nearest the end surface 38 of the adapter receiving portion 14.

A pair of spaced apart generally parallel load transferring surfaces 48 are disposed in the adapter receiving portion 14 and located in the cavity 40 adjacent the bottom thereof. The pair of load transferring surfaces 48 are oriented parallel with and in alignment with the pair of load bearing surfaces 18 of the tooth mounting portion 12.

Each surface of the pair of side wall surfaces 24 form an angle in the range of 4 to 8 degrees with respect to a reference plane 50. The respective side wall surfaces of the pair of side wall surfaces 24 are preferably angled with respect to the reference plane 50 at an angle of approximately 6 degrees. The reference plane 50 is parallel with and passes through the transverse opening 34 and is oriented perpendicular to both the pin opening 32 and the retainer opening 42. The pair of angled side wall surfaces 24 are farthest apart along the intersection thereof with the generally flat bottom surface 28.

A lifting eye 52 is disposed on the coupler 10 and located generally between the pin opening 32 and retainer opening 42 and operative to provide a connection for a lifting device for handling the coupler 10.

It is recognized that various forms of the coupler 10 could be utilized without departing from the essence of the invention. For example, if the size of the coupler is sufficiently small, the lifting eye 52 would not be needed. Furthermore, even though the first and second protuberances 44,46 are illustrated as material filling a chordal sector of the retainer opening 42 at opposite ends thereof, the first and second protuberances 44,46 could be formed by various methods. Additionally, the first and second protuberances could be located anywhere along the retainer opening 42 as opposed to being located immediately adjacent the opposite ends thereof as illustrated or could be completely eliminated. Likewise, the pair of side wall surfaces 24 of the respective grooves of the pair of spaced apart grooves 22 could be oriented parallel with the reference plane 50 instead of being angled therewith.

INDUSTRIAL APPLICABILITY

In the assembly and operation of the coupler 10, the coupler 10 is mounted on the adapter of the implement in such a manner that the cavity 40 encircles a portion of the adapter and a locking pin is placed through the retainer opening 42 to secure the coupler 10 to the adapter. Once the coupler 10 is secured to the adapter, a pin retaining member (not shown) is placed in the transverse opening 34 and the tooth is placed on the tooth mounting portion 12 such that tongues on the tooth are located in the respective ones of the pair of spaced apart grooves 22. The tooth is secured in position by a pin (not shown) being placed through openings in the tooth and the aligned pin opening 32, thus, securing the tooth in the installed position. The pin is held in its assembled position by the pin retaining member. The assembly and disassembly of the coupler to the adapter and the tooth to the coupler is both quick and relatively easy to accomplish.

The pair of load bearing surfaces 18 on the tooth mounting portion 12 are operative to effectively transfer any loads being encountered by the tooth into the coupler 10. The pair of spaced apart load transferring surfaces 48 located in the cavity 40 then effectively transfers the noted forces effectively into corresponding surfaces on the adapter of the implement. The pair of side wall surfaces 24 of the pair of spaced apart grooves 22 are operative in use to mate with complementary surfaces on the tongues of the tooth to retain the tongues in their assembled position and to also receive forces therefrom and transfer the forces into the adapter. Since this arrangement effectively transfers forces from the tooth to the adapter of the implement, the coupler is very effective when being operated in harsh operating conditions.

Other aspects, objects and advantages of this invention can be obtained through a study of the drawings, the disclosure, and the appended claims.

I claim:

1. A coupler adapted to connect a tooth to an adapter, comprising:

a tooth mounting portion having a nose portion with a pair of spaced apart generally parallel transverse load bearing surfaces, a pair of generally parallel spaced apart grooves, located adjacent the nose portion and extending rearwardly therefrom, a pair of generally parallel spaced apart mounting surfaces located in overlapping relationship with the nose portion, a pin opening defined therein between the pair of generally parallel spaced apart mounting surfaces and oriented generally perpendicular to the pair of load bearing surfaces, and a transverse opening defined in the nose portion generally perpendicular with and in intersecting relationship with the pin opening; and an adapter receiving portion having an end surface, a cavity defined therein extending inwardly from the end surface, a pair of aligned retainer openings extending through the adapter receiving portion in intersecting relationship with the cavity, and a pair of spaced apart generally parallel load transferring surfaces located in the cavity generally adjacent the bottom thereof.

2. The coupler of claim 1 wherein the pair of spaced apart load transferring surfaces is transversely oriented in the cavity and is oriented generally parallel with the pair of spaced apart load bearing surfaces.

3. The coupler of claim 2 wherein the pair of aligned retainer openings each have an inner and outer end and the retainer openings are orientated generally perpendicular to the pair of spaced apart load transferring surfaces.

4. The coupler of claim 3 wherein each groove of the pair of grooves is defined by the intersection of a pair of side wall surfaces, an end wall surface, and a generally flat bottom surface.

5. The coupler of claim 4 wherein the side wall surfaces of each groove of the pair of grooves are angled one relative to the other and the side wall surfaces are farthest apart along the intersection with the generally flat bottom surface.

6. The coupler of claim 5 wherein each of the side wall surfaces is angled in the range of 4 to 8 degrees with respect to a reference plane that is parallel with and passes through the center of the transverse opening and that is perpendicular with both the pin opening and the retainer opening.

7. The coupler of claim 6 wherein each of the side wall surfaces is angled approximately 6 degrees with respect to the reference plane.

8. The coupler of claim 2 wherein the pair of aligned openings each have an inner and outer end and including a protuberance disposed in a portion of one of the retainer openings and located generally adjacent one end of the one retainer opening and on the side of the opening nearest the end surface of the adapter receiving portion.

9. The coupler of claim 8 wherein the protuberance is located in the retainer opening immediately adjacent the outer end of the retainer opening.

10. The coupler of claim 8 including a second protuberance disposed in a portion of the other opening and located immediately adjacent the outer end of the other retainer opening and on the side of the opening nearest the end surface of the adapter receiving portion.

* * * * *